United States Patent [19]

Petzl et al.

[11] 4,429,351

[45] Jan. 31, 1984

[54] ELECTRIC LAMP WITH A SINGLE DEVICE FOR FOCUS-CONTROL AND SWITCH-CONTROL

[75] Inventors: Paul Petzl, St. Vincent de Mercuze; Pierre Petzl, Crolles, both of France

[73] Assignee: Establissements Petzel, France

[21] Appl. No.: 428,659

[22] Filed: Sep. 30, 1982

[30] Foreign Application Priority Data

Sep. 28, 1981 [FR] France ..... 81 18367

[51] Int. Cl.[3] ..... F21L 7/00

[52] U.S. Cl. ..... 362/187; 200/60; 362/103; 362/105; 362/204; 362/205; 362/206; 362/277

[58] Field of Search ..... 362/187, 204, 205, 206, 362/103, 105, 277; 200/60

[56] References Cited

U.S. PATENT DOCUMENTS 4,261,026 4/1981 Bolha ..... 362/101
4,329,740 5/1982 Colvin ..... 362/205

FOREIGN PATENT DOCUMENTS 839828 4/1952 France .
1430456 1/1966 France .
2372382 11/1976 France .

*Primary Examiner*—Stephen J. Lechert, Jr.
*Attorney, Agent, or Firm*—Stevens, Davis, Miller & Mosher

[57] ABSTRACT

An electric lamp with a parabolic reflector in a threaded collar, provided with a device for adjusting the focus by relative displacement between the bulb and the reflector which occurs when turning the collar on its threads between first and second adjusting positions. The device furthermore controls a switch housed within the casing for the device. The device is particularly applicable as an electric headlamp for mountain-climbers or spelunkers.

7 Claims, 6 Drawing Figures

ELECTRIC LAMP WITH A SINGLE DEVICE FOR FOCUS-CONTROL AND SWITCH-CONTROL

BACKGROUND

The invention concerns an electric lighting lamp with an insulating casing enclosing a parabolic reflector, an electric bulb electrically connected to a power source through a switch, and a common or single control means for the switch and lighting adjustment by adjusting the focus as a result of relative translation between bulb and reflector, said casing being subdivided into a first sub-assembly consisting of the reflector rigidly joined to a rotational adjustment collar, and a second sub-assembly supporting the electric bulb and the switch, the two sub-assemblies cooperating to cause relative displacement when the collar is actuated.

French Pat. No. 1,430,456 and West German Pat. No. 839,838 each describe a lighting lamp which comprises a common means to adjust the focus and control the switch. The switch includes a rotational control which renders the structure of the common control means complex. In French Pat. No. 2,372,382, the switch consists of the translational bulb holder which can be applied against a stationary contact due to reflector displacement.

BRIEF SUMMARY OF THE INVENTION

An object of the invention is to achieve a reliable lighting lamp provided with a simple and low cost switch.

The lamp of the present invention is characterized in that the switch comprises a semi-stationary contact contacted by an elastic means making contact with one bulb terminal, so that said contact remains stationary in the closed position when the reflector is translationally displaced between a first and a second focus-adjustment position, and is automatically separated from the terminal opposite the force exerted by the elastic means when the reflector is moving toward an end position outside the interval separating the first and second positions.

BRIEF DESCRIPTION OF THE DRAWINGS

Other advantages and features will appear more clearly in the discussion below of an illustrative embodiment of the invention provided in non-restrictive manner and shown in the accompanying drawings.

DETAILED DESCRIPTION

Figure 1:
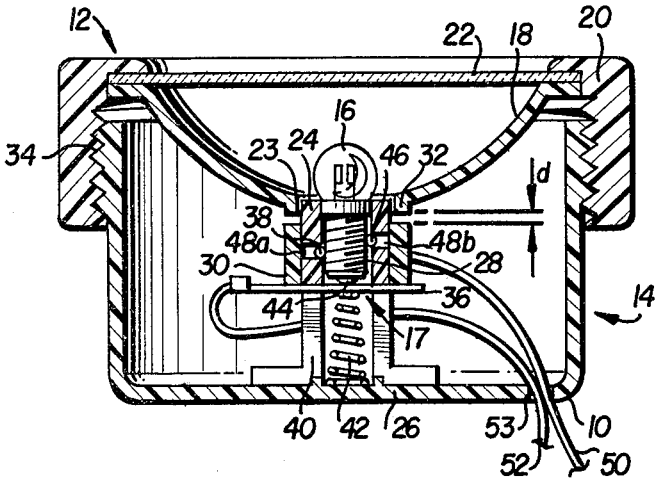
FIG. 1 is an axial section of the casing of the electric lamp of the invention with the switch in the closed position.
Figure 2:
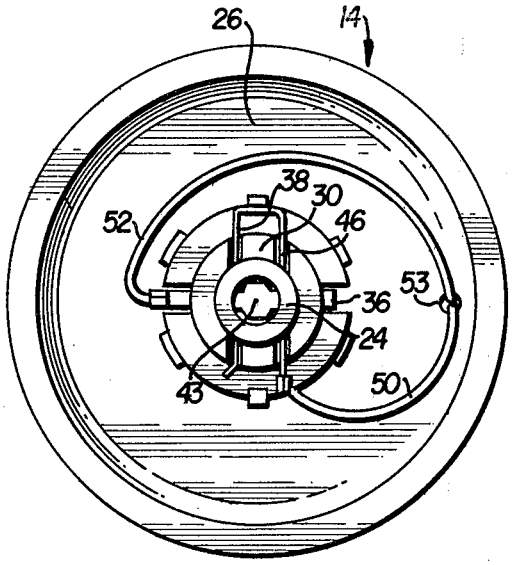
FIG. 2 is a plan view of FIG. 1, with the first sub-assembly of reflector and electric bulb removed.
Figure 3:
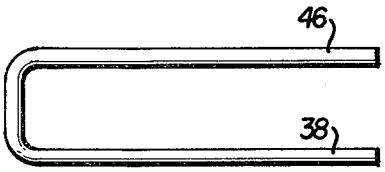
FIG. 3 is a view of the junction clip of the bulb's screw socket.
Figure 4:
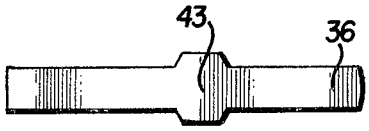
FIG. 4 is a view of semi-fixed switch contact.

In the figures, an electric lighting lamp, in particular a forehead lamp for mountain climbers or spelunkers, comprises a lighting casing 10 provided in two distinct sub-assemblies 12, 14 which can cooperate with each other to act as an electric switch to put the bulb 16 in or out of the circuit, and to condense or diffuse the light beam emitted by the bulb 16 for the closed position of the switch 17.

The sub-assembly 12 comprises a parabolic reflector 18 solidly joined to a collar 20 made of an insulating material of which the inside surface is threaded to form a nut. The opening in the nut-collar 20 is sealed by a cylindrical transparent screen 22 protecting the reflector 18 and the bulb 16. A cylindrical opening 23 is fashioned in the central part of the reflector 18 to allow the bulb 16 to pass therethrough.

The other sub-assembly 14 is designed as a support for the bulb 16 and its associated switch 17. A tubular sleeve 24 for seating the bulb 16 is fastened to the bottom 26 of the casing by any suitable assembly procedure, for example such as by bonding or clip-mounting. The outside diameter of the fixed sleeve 24 is slightly less than that of the aperture 23 of the reflector 18, and the inside diameter of the sleeve 24 substantially corresponds to that of the screw socket 28 of the bulb 16. The semi-stationary insulating collar 30 controlling the switch 17 coaxially surrounds the fixed sleeve 24 and can be axially translated to a limited extent by an annular flange 32 of the reflector 18 to open the switch 17 when collar 30 is at the end of its course. The cylindrical casing 10 of the sub-assembly 14 is provided with an external thread 34 onto which is screwed the nut-collar 20 of the conjugate sub-assembly 12.

The fixed sleeve 24 housing the screw socket 28 of the bulb 16 is made of an insulating material and bulb 16 is electrically fed from a standard commercial power supply through two electric contacts 36, 38 within the casing 10.

One of the contacts 36 is designed as a semi-stationary bridge means extending transversely within an orifice 40 of the sleeve 24. A compression spring 42 is housed coaxially within the sleeve 24 between the bottom 26 and the bridge-shaped contact 36 to act on widened central zone 43 of contact 36 to force it against the insulated terminal 44 connected to the filament of the bulb 16. The switch 17 is composed of this bridge-shaped semi-stationary contact 36 cooperating with the insulating control collar 30 as a function of the axial position of the reflector 18. At the beginning of the screwing procedure of the sub-assembly 12 on the thread 34 of the sub-assembly 14, a dead, or non-functional travel of variable length d is provided between the flange 32 of the reflector 18 and the collar 30. The switch 17 then is in the closed position because the bridge means 36 is kept in contact with the terminal 44 of the bulb 16 under the action of the spring 42. After the dead travel d has been closed due to further turning of the sub-assembly 12, the reflector 18 in its further displacement drives the collar 30 into a position away from the contact bridge 36 and against the force of the spring 42. Then the contact bridge 36 is separated from the terminal 44 of the bulb 16 and the switch 17 presently is open.

The other power supply contact 38 of the bulb 16 comprises a clip or broach 46 to ground the screw metal socket 28 which is the other terminal of the bulb 16. The clip 46 is perpendicular to the contact bridge 36 of the switch 17 and consists of metallic conducting wire bent back in a horseshoe shape. The straight arms of the clip 46 are located within a pair of clearances **48*a*,48*b* in the fixed sleeve 24, and the radial space between the arms of the U-shaped clip 46 corresponds substantially to the bottom diameter of the threads of the screw socket 28 of the bulb 16. One of the clearances, 48*a*, is axially offset from the conjugate clearance 48***b* by a slight axial spacing corresponding to about half a pitch of the screw socket 28. The clip 46 and the contact bridge 36 are connected to two jumper leads 50,52 passing through the casing 10 through an orifice 53 to connect the bulb 16 to an external supply source, such as a battery (which is not illustrated). In addition to its function of electrically connecting the socket 28 of the bulb 16 to one of the supply source poles, the clip 46 also maintains the bulb 16 in stable position within the fixed insulating sleeve 24, the lateral inside surface of which is without threads. A housing for the supply battery is not shown in the figures, being of a conventional type such as described in French Pat. No. 2,305,684.

Figure 5:
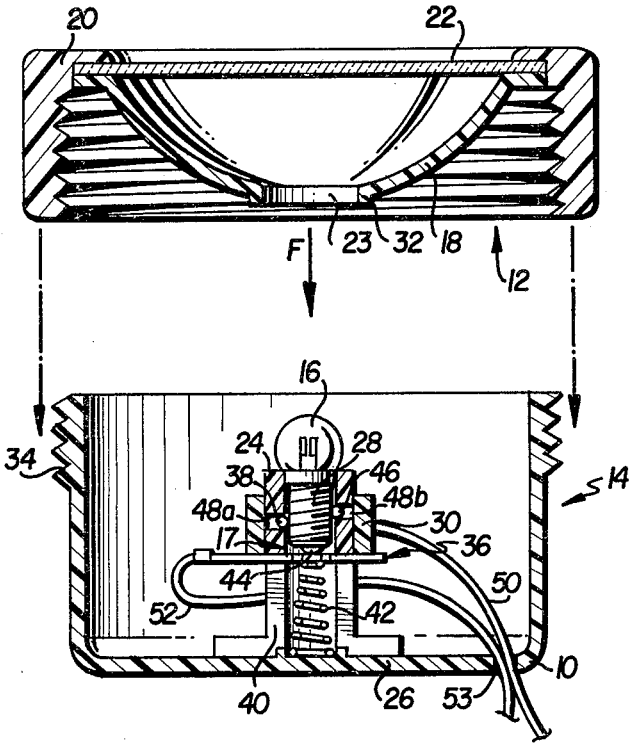
FIG. 5 is a view identical to FIG. 1 for the disassembled position of the first and second sub-assemblies.

The lamp of the present invention operates as follows:

Bulb 16 is installed in the fixed sleeve 24 of the sub-assembly 14 when the sub-assembly 12 is disassembled (FIG. 5), by rotating the screw socket 28 of the bulb 16 on the connecting clip 46 which is stably positioned in the clearances 48*a*,48*b* of the sleeve 24. The bulb 16 is rotated until the terminal 44 engages the contact zone 43 of the bridge 36. The opposite side of the bridge is subjected to the action of the spring 42 and the switch 17 then is in the closed position for the supply circuit for the bulb 16 which then is lit.

Next the sub-assembly 12 with the reflector 18 is moved toward the sub-assembly 14 in the direction of the arrow F and is screwed onto it by rotating the collar 20 on the thread 34 of the casing 10 (FIG. 1). The helical rotation of the collar 20 generates a translational motion of the reflector 18 toward the semi-stationary collar 30. The dead travel d between the flange 32 of the reflector 18 and the collar 30 decreases as the collar 20 is turned. The decrease in the dead travel distance d causes the focus of the parabolic reflector 18 to approach the bulb 16, which remains stationary. As a result there is progressive condensation of the light beam emitted by the bulb 16. The beam focusing will be maximized after the dead travel distance d is closed. The collar 30 hits the contact bridge 36 due to the action of the reflector 18.

Figure 6:
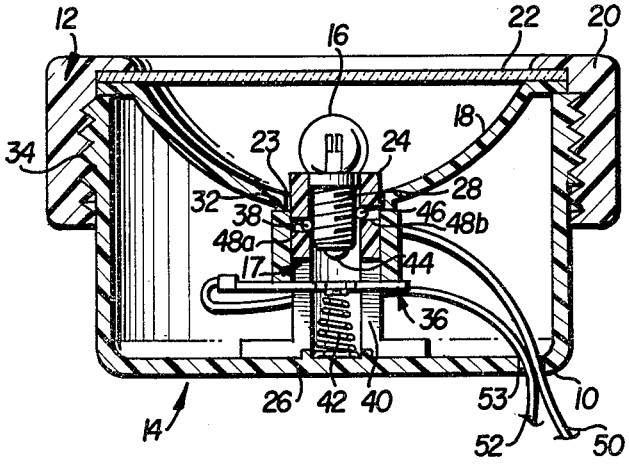
FIG. 6 is a view similar to that of FIG. 1, with the switch in the open position.

Continued turning of the nut-collar 20 drives the collar 30 and the contact bridge 36 into limited translation against the elastic force of the compression spring 42. The bulb 16 remaining stationary, the terminal 44 is separated from the contact bridge 36 and the switch 17 then is open when the reflector 18 has traveled its course (FIG. 6). The bulb 16 is extinguished and the spring 42 is maximally compressed.

The bulb 16 lights again during the reverse procedure. The reverse rotation of the collar 20 withdraws translationally the collar 30 in the direction of action of the spring 42. The contact bridge 36 follows the motion of the collar 30 until it makes contact with the terminal 44. Thereupon the switch 17 is closed and the bulb 16 is lit. Continued unscrewing of the nut-collar 20 causes the focus of the reflector 18 to move away from the fixed bulb 16. As a result the light beam emitted by the bulb 16 progressively becomes less condensed.

The invention is not specifically restricted to the particular described implementation above and shown in the attached drawings, but rather is intended to cover any variation within the scope of equivalency, in particular where the sequence of the focus adjustment and control operations for the switch 17 would differ from that described above.

What is claimed is:

1. An electric lighting lamp comprising:

a first casing subassembly comprising a rotatably adjustable nut collar, a parabolic reflector joined to said rotatably adjustable nut collar and a transparent screen contained in said nut collar, said reflector defining a cylindrical opening arranged in the central portion thereof surrounded by an annular flange to allow passage of an electrical bulb therethrough upon rotation of said nut collar, the inside surface of said collar being threaded to form a nut;

a second casing subassembly including a cylindrical container with an external thread on one end comprising a fixed tubular sleeve member having notches therein secured to said container for holding said electrical bulb, said second casing cooperating with said first casing subassembly so as to cause an axial translation displacement when said nut collar is rotated relative to said container, said first and second subassemblies being moved toward and away from one another during said displacement;

switch means for connecting said bulb to an electric current source comprising a semi-stationary contact bridge extending transversely within an orifice of said sleeve member, and having a face cooperating in the closed position of said switch means with a connecting terminal for said bulb;

elastic means for urging said semi-stationary contact bridge against said connecting terminal when the reflector of said first casing subassembly is moved between first and second axially translated positions of said displacement, defining a predetermined course for adjusting the light focus of said lighting lamp;

and control means cooperating with said contact bridge which is automatically separated from said connecting terminal against the action of said elastic means, thereby opening the switch during further translation of said reflector toward an end position disposed outside said first and second positions of the adjustable light focus course.

2. The electric lighting lamp according to claim 1, wherein said elastic means includes a compression spring located within said tubular sleeve member between the bottom of said second casing subassembly and said semi-stationary contact bridge.

3. The electric lighting lamp according to claim 1, wherein said control means of the switch means comprises an insulating collar arranged axially between said semi-stationary contact bridge and said reflector with interposition of a dead travel "d" corresponding to the adjustable light focus course between said first and second positions.

4. The electric lighting lamp according to claim 3, wherein said insulating collar surrounds coaxially said fixed sleeve member so as to be pushed by said annular flange of said reflector to open the switch means when said first casing subassembly reaches said end position.

5. The electric lighting lamp according to claim 1, including a clip of conducting material and wherein said electrical bulb includes a screw metal socket cooperating with said clip of conducting material located within notches or clearances of the fixed sleeve member, said clip and said semi-stationary contact bridge being electrically connected to said electric current source for the supply of the bulb during the adjustable light focus course.

6. The electric lighting lamp according to claim 5, wherein said clip cooperating with said socket of the bulb consists of a U-shaped metal wire, where the distance between the straight arms of the U corresponds substantially to the bottom diameter of the threads of the screw socket.

7. The electric lighting lamp according to claim 6, wherein said notches for positioning the clip are mutually offset by an axial distance to half a pitch of the screw socket threads.

* * * * *